US012589838B1

(12) United States Patent
Kimura

(10) Patent No.: US 12,589,838 B1
(45) Date of Patent: Mar. 31, 2026

(54) METHOD FOR TRANSFERRING ENERGY STORAGE MEDIUM BETWEEN POWER GENERATION FLOATING BODY AND TRANSPORT VESSEL IN OFFSHORE POWER GENERATION SYSTEM

(71) Applicant: TOYOTA JIDOSHA KABUSHIKI KAISHA, Toyota (JP)

(72) Inventor: Kazutaka Kimura, Mishima (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 19/264,104

(22) Filed: Jul. 9, 2025

(30) Foreign Application Priority Data

Sep. 27, 2024 (JP) ..... 2024-168800

(51) Int. Cl.
*B63B 27/36* (2006.01)
*B63B 27/10* (2006.01)
(Continued)

(52) U.S. Cl.
CPC ..... *B63B 27/36* (2013.01); *B63B 27/10* (2013.01); *B63B 79/15* (2020.01); *B63B 79/40* (2020.01)

(58) Field of Classification Search
CPC . Y02E 10/30; Y02E 60/10; B63B 2035/4453; B63B 2035/446;
(Continued)

(56) References Cited

U.S. PATENT DOCUMENTS 9,321,510 B2 * 4/2016 Rikoski ..... B22D 31/00
10,309,374 B2 * 6/2019 Nelson ..... B64U 10/60
(Continued)

FOREIGN PATENT DOCUMENTS

JP 2013-184525 A 9/2013
JP 5884978 B2 3/2016
JP 2024-080145 A 6/2024

OTHER PUBLICATIONS

L. Wei, et al., "Power Efficient Deployment Planning for Wireless Oceanographic Systems," in IEEE Systems Journal, vol. 12, No. 1, pp. 516-526, Mar. 2018, doi: 10.1109/JSYST.2016.2533396. (Year: 2018).*

*Primary Examiner* — Gregory W Adams
(74) *Attorney, Agent, or Firm* — SoraIP, Inc.

(57) ABSTRACT

A method of transferring a storage medium on the ocean between a power generation floating body that generates electricity on the ocean and stores energy obtained by the power generation in the storage medium and a transport vessel that transports the storage medium includes a first process of moving the power generation floating body to a predetermined sea area and dropping the first storage medium loaded on the power generation floating body onto the ocean, a second process of moving the transport vessel to a predetermined sea area and dropping the second storage medium loaded on the transport vessel onto the ocean, a third process of recovering the second storage medium dropped from the transport vessel to the ocean to the power generation floating body, and a fourth process of recovering the first storage medium dropped from the power generation floating body onto the transport vessel.

5 Claims, 4 Drawing Sheets

(51) Int. Cl.
*B63B 79/15* (2020.01)
*B63B 79/40* (2020.01)

(58) Field of Classification Search
CPC . B63B 2035/4466; B63B 35/00; B63B 27/36; B63B 79/15; B63B 79/40; B63B 27/10; B63B 2035/007; B63B 22/00; H01M 2220/20
See application file for complete search history.

(56) References Cited

U.S. PATENT DOCUMENTS

| | | | | |
|---|---|---|---|---|
| 11,258,105 | B2 * | 2/2022 | Sarokhan | H01M 10/425 |
| 11,542,913 | B1 * | 1/2023 | Hammagren | F03B 13/20 |
| 2010/0122529 | A1 * | 5/2010 | Kroll | F03B 13/1865 60/504 |
| 2011/0155039 | A1 * | 6/2011 | Moore | F03B 13/14 114/326 |
| 2017/0363069 | A1 * | 12/2017 | Hart | B64C 39/022 |
| 2018/0134357 | A1 * | 5/2018 | Vestel | B63B 1/28 |

* cited by examiner

METHOD FOR TRANSFERRING ENERGY STORAGE MEDIUM BETWEEN POWER GENERATION FLOATING BODY AND TRANSPORT VESSEL IN OFFSHORE POWER GENERATION SYSTEM

CROSS-REFERENCE TO RELATED APPLICATION

This application claims priority to Japanese Patent Application No. 2024-168800 filed on Sep. 27, 2024. The disclosure of the above-identified application, including the specification, drawings, and claims, is incorporated by reference herein in its entirety.

BACKGROUND

1. Technical Field

The present disclosure relates to a method for transferring a storage medium that stores energy, obtained by a floating body (power generation floating body) that is a vessel or the like equipped with a power generator at sea in an offshore power generation system, between a transport vessel and the power generation floating body at sea.

2. Description of Related Art

Offshore wind power generation is gaining attention as one of several methods to obtain renewable energy. At sea, wind can be expected to blow stably in the same direction and with the same strength with few restrictions such as those regarding land and roads, and an advantage of wind power generation, in which electricity can be generated in a stable manner even at night, can be put to good use. For this reason, various technologies related to offshore wind power generation have been proposed. For example, Japanese Unexamined Patent Application Publication No. 2024-80145 (JP 2024-80145 A) proposes an offshore energy collection system including a plurality of floating power generation devices and a platform that is separate from these floating power generation devices. The system includes microwave transmitters and a microwave receiver. The microwave transmitters transmit, by microwaves, generated electric power that is generated by the floating power generation devices that are in a state of floating at sea. The microwave receiver on the platform receives the microwaves that are transmitted by each of the microwave transmitters of the floating power generation devices. The microwave transmitters and the microwave receiver have array antennas in which a plurality of element antennas is arrayed. The microwave transmitters transmit transmission power to the microwave receiver by retrodirective operations. The microwave receiver receives coherent microwaves with aligned frequency and phase from the floating power generation devices.

SUMMARY

A bottom-mounted system (system in which a power generator is fixed on the seabed) that is installed in a shallow sea area relatively close to land, and a floating system (system in which a power generator is installed in an offshore floating body such as a vessel or the like) that can be deployed in deep sea areas, have been proposed and developed as offshore power generation systems using wind energy and tidal current energy. Of these systems, the floating system is advantageous in that a power generation floating body can be relocated as appropriate to a sea area with stronger wind and tidal power where power can be generated better, and thus energy can be efficiently recovered. However, the floating system differs from the bottom-mounted system with respect to how the energy that is obtained by offshore power generation is delivered to the location of consumption. Laying cables for power transmission from the system to the land is extremely difficult. It may also be difficult to transmit electric power by microwaves as in JP 2024-80145 A (the transmission distance may be too long). Accordingly, electric energy that is generated by the power generation floating body is charged to a battery in the floating system. Alternatively, the electrical energy is converted to chemical energy that is retained by hydrogen gas generated through hydrolysis reaction imposed by the energy. The hydrogen gas, or liquid hydrogen that is obtained by liquification of the hydrogen gas, is stored in a tank or the like, thereby storing the energy in a storage medium (battery or hydrogen tank) that is loaded on the power generation floating body. A transport vessel is sent to the sea area where the power generation floating body is present, in a timely manner. The medium in which energy is stored is transferred from the power generation floating body to the transport vessel. The medium in which energy is to be stored is transferred from the transport vessel to the power generation floating body. According to this method, the storage medium can be recovered without relocating the power generation floating body too far from the sea area of an offshore power generation site, which is advantageous in that the power generation floating body can spend a longer time generating power.

With regard to transfer of the storage medium between power generation floating bodies and the transport vessel at sea as described above, there are cases in which sizes and shapes of the power generation floating bodies and the transport vessel vary. An ability to transfer the medium regardless of difference in the size and shape of hull of the vessel would be advantageous, since power generation floating bodies and transport vessels of any size and shape could be used. With respect to this point, when the storage medium is transferred by directly linking the power generation floating body and the transport vessel, for example, the size and shape of each of the power generation floating body and the transport vessel are restricted.

In view of the above, it is a primary object of the present disclosure to provide an offshore power generation system that is capable of achieving transfer of a storage medium for energy that is generated by a power generation floating body between the power generation floating body and a transport vessel of any size and shape.

According to the present disclosure, the aforementioned object is achieved by a method of transferring a storage medium at sea, between a power generation floating body that generates electric power at sea and stores energy that is obtained by the power generation in the storage medium, and a transport vessel that transports the storage medium, the method including

- a first process of relocating the power generation floating body to a predetermined sea area and dropping a first storage medium that is loaded on the power generation floating body into the sea,
- a second process of relocating the transport vessel to the predetermined sea area and dropping a second storage medium that is loaded on the transport vessel into the sea, a third process of causing the power generation floating body to recover the second storage medium that was dropped from the transport vessel into the sea, and a fourth process of causing the transport vessel to recover the first storage medium that was dropped from the power generation floating body into the sea.

In the above configuration, the "power generation floating body" may be an offshore floating body that is equipped with any type of wind power generation system, which may typically be a kite-type power generation system, or any other power generation system that is carried out at sea. The "storage medium" is loaded on the power generation floating body, and energy that is obtained by the power generation is stored in any form. Specifically, the "storage medium" may be a battery that charges electric energy as such, or may be a tank that stores hydrogen gas that is generated by a hydrolysis reaction using the electric energy that is obtained by power generation, or liquid hydrogen that is obtained by liquefying the hydrogen gas. In the power generation floating body, a plurality of the storage media is loaded in loading spaces that are appropriately configured. At the time of power generation, the power generation system that is installed on the power generation floating body may be configured to charge the generated electric power to a battery that is the storage media, in order. Alternatively, the power generation system may be configured such that the hydrogen gas or the liquefied hydrogen that is generated, by using power generation energy, is stored in tanks that are the storage media, in order. The transport vessel may be any type of vessel that is capable of transporting the storage media. "First storage medium" is typically a storage medium in which the energy that is generated by the power generation floating body is stored, and "second storage medium" is typically a storage medium that is capable of storing energy or that is empty. "Predetermined sea area" may be a sea area that is appropriately set, in which the storage medium can be transferred between a power generation medium and the transport vessel.

According to the above configuration, in the first process, the power generation floating body is relocated to the predetermined sea area at which the first storage medium, which was loaded on the power generation floating body, is dropped into the sea. In the second process, the transport vessel is relocated to the predetermined sea area at which the second storage medium, which was loaded on the transport vessel is dropped into the sea. In the third process, the power generation floating body recovers the second storage medium that was dropped into the sea by the transport vessel. In the fourth process, the transport vessel recovers the first storage medium that was dropped into the sea by the power generation floating body. This allows the transfer of the storage medium between the power generation floating body and the transport vessel, i.e. the transfer of the medium in which energy is stored from the power generation floating body to the transport vessel, and the transfer of the medium in which energy is to be stored to the power generation floating body from the transport vessel, without directly docking the power generation floating body and the transport vessel, whereby transfer of the storage medium between the power generation floating body and the transport vessel of any sizes and shapes is achieved.

In the above-described configuration, it is preferable that the predetermined sea area is divided into an area for dropping the first storage medium from the power generation floating body and an area for dropping the second storage medium from the transport vessel, such that selectively recovering the first storage medium and the second storage medium by the transport vessel and the power generation floating body, respectively, is facilitated. Therefore, in the method of the present disclosure described above, preferably, in the first process, the power generation floating body may be relocated to a first region in the predetermined sea area at which the first storage medium is dropped. In the second process, the transport vessel may be relocated to a second region in the predetermined sea area at which the second storage medium is dropped. In the third process, the power generation floating body may be relocated to the second region and recover the second storage medium onto the power generation floating body. In the fourth process, the transport vessel may be relocated to the first region and recover the first storage medium onto the transport vessel.

In addition, in the above-described configuration, the first and the second storage media that are dropped into the sea may be configured to float on the sea, since the first and the second storage media are easily recovered by the transport vessel and the power generation floating body when remaining near the surface of the sea.

As described above, recovery of the first and the second storage media that were dropped into the sea may be achieved by any technique. With respect to this point, a method may be employed in which a large net is deployed offshore to scoop up the storage medium at sea, as described in Japanese Unexamined Patent Application Publication No. 2013-184525 (JP 2013-184525 A), for example. In order to make the arrangement for recovery more compact, in one embodiment, a hook may be provided to each of the first and the second storage media. The power generation floating body and the transport vessel each extends an arm, including an engaging arrangement for engaging the hook, over the sea to engage the hook with the engaging arrangement. Thereafter, the power generation floating body and the transport vessel retract their arms to draw near and recover the first and the second storage media.

Preferably, the recovery of the first and the second storage media that were dropped into the sea can be achieved automatically or unmanned. Accordingly, the power generation floating body and the transport vessel may each have a detector for detecting the second and the first storage media at sea, and be configured to identify positions of the second and the first storage media by the detector and to automatically recover the second and the first storage media. In an embodiment, the storage medium may be provided with an arrangement for emitting particular radio waves, light, or the like, or an arrangement for reflecting particular radio waves, light, or the like, that are emitted from the transport vessel or the power generation floating body. The detector in the transport vessel or the power generation floating body may detect radio waves, light, or the like from the storage medium. An arrangement for recovering the storage medium, e.g., an arm having an engagement arrangement for engaging a hook of the storage medium, may be extended to a location where the radio waves, light, or the like, are sensed. The engagement arrangement is engaged with the hook of the storage medium. Thereafter, the arm is retracted and the storage medium is drawn to the power generation floating body and the transport vessel and recovered.

Thus, according to the method of the present disclosure, there is no restriction on the size and shape of each of the power generation floating body and the transport vessel regarding the transfer of the energy storage medium between the power generation floating body and the transport vessel in the offshore power generation system. Power generation floating bodies and transport vessels of any size and shape can be used. With respect to this point, the transport vessel and the power generation floating body do not need to be in close proximity, and accordingly the storage media can be transferred under various sea conditions. Further, setting the predetermined sea area in an edge area of a power generation sea area for the power generation floating body, for example, does away with the need to largely relocate the power generation floating body from the power generation sca area in order to perform transfer of the storage media. This improves rate of operation for implementing power generation. Accordingly, costs can be reduced.

Other objects and advantages of the present disclosure will become apparent from the following description of preferred embodiments of the present disclosure.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1A:
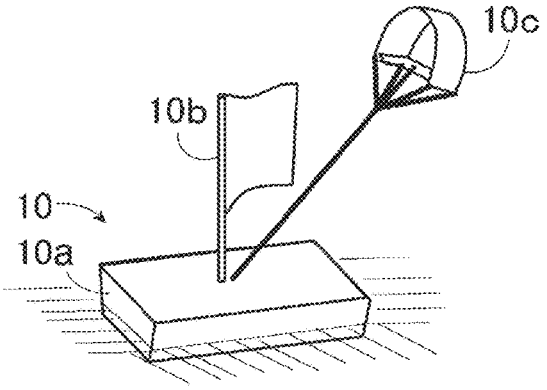
FIG. 1A is a schematic view of a power generation floating body used in an offshore wind power generation system according to an embodiment of the present disclosure.

The disclosure will now be described in detail in accordance with some preferred embodiments with reference to the accompanying drawings, in which: In the drawings, the same reference numerals denote the same parts.

Configuration of Power Generation Floating Body and Storage Medium

The method according to the present embodiment is applied to the offshore transfer of an energy storage medium between a transport vessel and a power generation floating body in an offshore power generation system. The offshore power generation system may in particular be any type of wind power generation system or other power generation system (such as a tidal current, tidal power-based system) that is implemented offshore. In such a system, the power generation floating body is configured to move to an area on the ocean where it can generate better to perform power generation and to store the resulting energy in a storage medium in any manner. As the power generation floating body, for example, a floating body 10 may be adopted in which a sale 10*b* or the like for driving is provided on a floating body main body 10*a* floating on the ocean as schematically depicted in FIG. 1A, and a kite-type power generator 10*c* is mounted. The power generated is stored in a storage medium (not shown) that is appropriately loaded on the main body 10*a*.

As a method of storing energy, as already mentioned in the Summary of the Disclosure, electric energy obtained by power generation is converted into hydrogen energy (chemical energy of hydrogen molecules) by generation of hydrogen gas by a water decomposition reaction. Energy may be stored by compressing or liquefying hydrogen gas that retains energy and storing it in a tank. In this case, the storage medium is a hydrogen tank. Alternatively, in another embodiment, the resulting electrical energy may be stored by charging the battery. In this case, the storage medium is a battery.

Figure 1B:
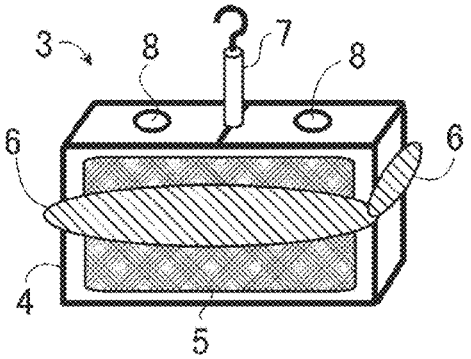
FIG. 1B is a schematic perspective view of a storage medium used for storing power generation floating body.

In the method according to the present embodiment, the storage medium is dropped onto the ocean from the power generation floating body and the transport vessel, respectively, as already mentioned in the summary section of the disclosure, and then recovered into the transport vessel and the power generation floating body. Thus, preferably, the storage medium is configured to float on the surface of the water to facilitate recovery on the ocean. Specifically, as schematically depicted in FIG. 1B, the storage medium 3 has a configuration in which a main body 5, which may be a hydrogen tank or a battery, is accommodated in an arbitrarily shaped frame 4. Further, a floating bag or other floating body 6 for floating the storage medium 3 on the water surface may be attached to the periphery of the frame 4. Further, the outer surface of the storage medium 3 may be provided with a hook 7 for engaging with an arm or the like that pulls the storage medium 3 to the transport vessel and the power generation floating body on the ocean as described later. A marker means 8, such as a light emitter or an oscillator, may be provided for the purpose of detecting the position of the storage medium 3 on the surface of the water from the transport vessel and the power generation floating body. It should be noted that the storage medium 3 may be placed in any manner on the transport vessel and on the power generation floating body.

Transfer of Storage Media (1) Overview

In the present embodiment, as described in the summary of the disclosure, the storage medium (the storage medium stored with energy) storing the energy generated by the power generation floating body is transferred from the power generation floating body to the transport vessel. In addition, a storage medium (an energy-storable or empty storage medium) for storing energy generated by the power generation floating body is transferred from the transport vessel to the power generation floating body. Transfer is performed in a predetermined sea area on the ocean by the power generation floating body and the transport vessel dropping the storage medium, and then the power generation floating body pulling up the storage medium dropped by the transport vessel, and the transport vessel pulling up the storage medium dropped by the power generation floating body.

Figure 2:
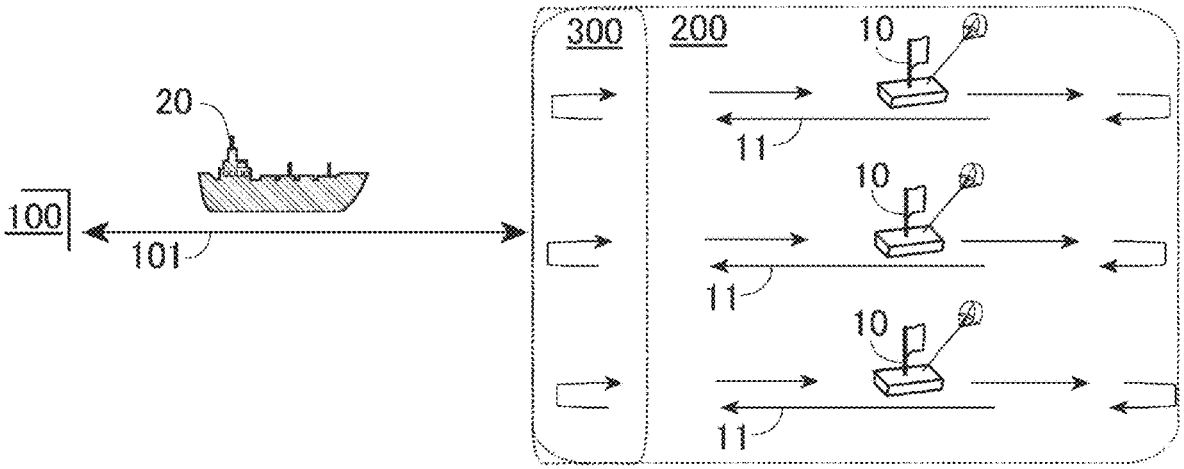
FIG. 2 is a diagram for explaining an outline of a method according to the present embodiment.

More specifically, typically, in an offshore power generation system, as schematically illustrated in FIG. 2, a plurality of power generation floating bodies 10 generate power while circulating a predetermined course 11 appropriately set in a sea area 200 suitable for power generation. The energy obtained is stored in a storage medium loaded therein. Thus, the storage medium in which energy is stored in each of the power generation floating bodies 10 needs to be transported to the port 100 where the storage medium is located, which is closer to the point of consumption of the energy. It is also necessary to load an energy-storable or empty storage medium on each of the power generation floating bodies 10. Therefore, it is inefficient to call each of the power generation floating bodies 10 at the port 100 because the power generation period in the power generation floating body is shortened by the required time. Therefore, in the present embodiment, as shown in the drawing, the transport vessel 20 is sent from the port 100 to the sea area 300 at the periphery of the sea area 200 where the power generation floating body 10 circulates in a timely manner. On the ocean of the sea area, an exchange between the energy-stored storage medium and the energy-storable or empty storage medium is carried out between the power generation floating body 10 and the transport vessel 20. As a result, the period in which the power generation floating body 10 stays in the sea area 200 becomes longer, and a longer power generation period can be obtained.

Further, as described above, in the case where the transport vessel 20 is sent to the sea area 300 and the exchange of the storage medium with the power generation floating body 10 is performed therein, in the case where the power generation floating body 10 and the transport vessel 20 are directly connected to each other, the structural constraints of the power generation floating body 10 and the transport vessel 20 are imposed. As a result, there is a possibility that the power generation floating body 10 and the transport vessel 20 of arbitrary size and shape cannot be used. Therefore, in the present embodiment, as described above, in the sea area 300 where the transport vessel 20 reaches, the power generation floating body 10 and the transport vessel 20 each drop the storage medium onto the ocean. The power generation floating body 10 pulls up the storage medium dropped by the transport vessel 20. The transport vessel 20 pulls up the storage medium dropped by the power generation floating body 10. As a result, the exchange of the storage medium on the ocean is achieved regardless of the size and shape of the power generation floating body 10 and the transport vessel 20.

In the above configuration, the power generation floating body 10 may be, for example, a 300 ton class vessel. The transport vessel 20 may be, for example, a vessel sized to 2000 tons class and capable of carrying as many as 100 ten ton class storage media.

(2) Process of Transfer of Storage Media

The transfer of the storage medium on the ocean between the power generation floating body 10 and the transport vessel 20 may be specifically performed as follows.

Figure 3A:
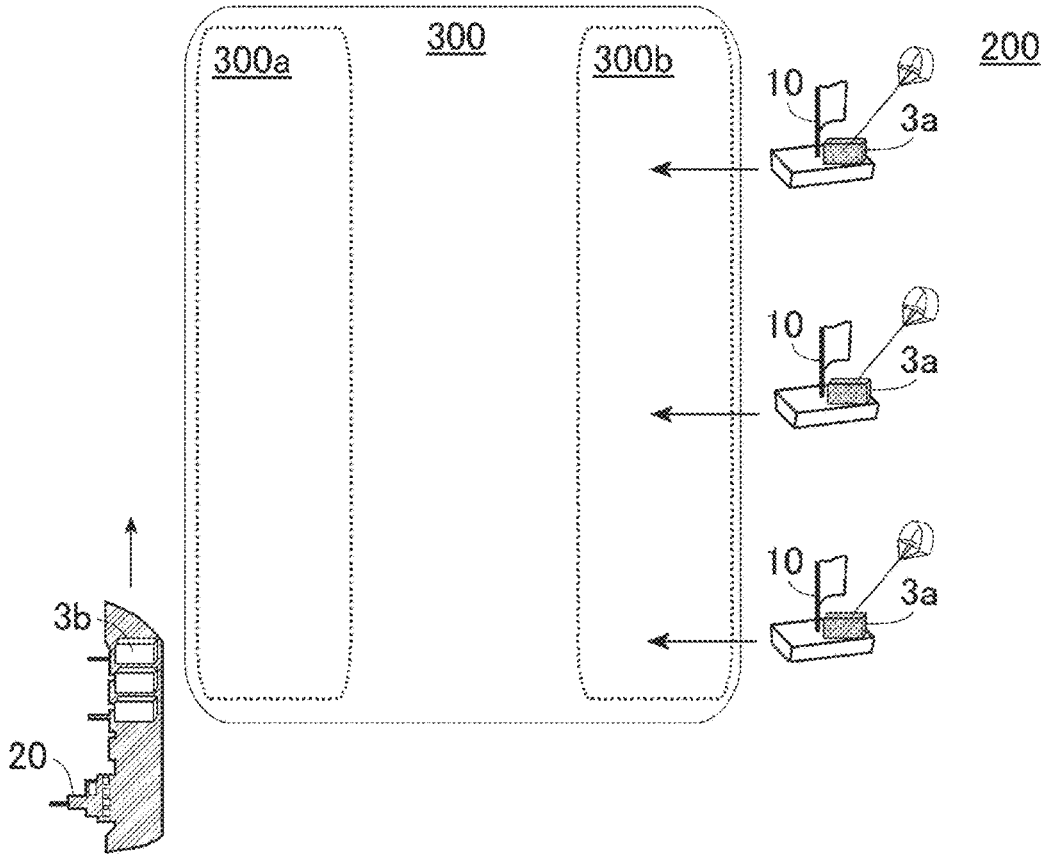
FIG. 3A is a diagram illustrating a process of transferring a storage medium between a power generation floating body and a transport vessel according to the present embodiment, wherein the power generation floating body is moved to a first area of a transfer sea area of the storage medium, and the transport vessel is moved to a second area of the transfer sea area of the storage medium.
Figure 3B:
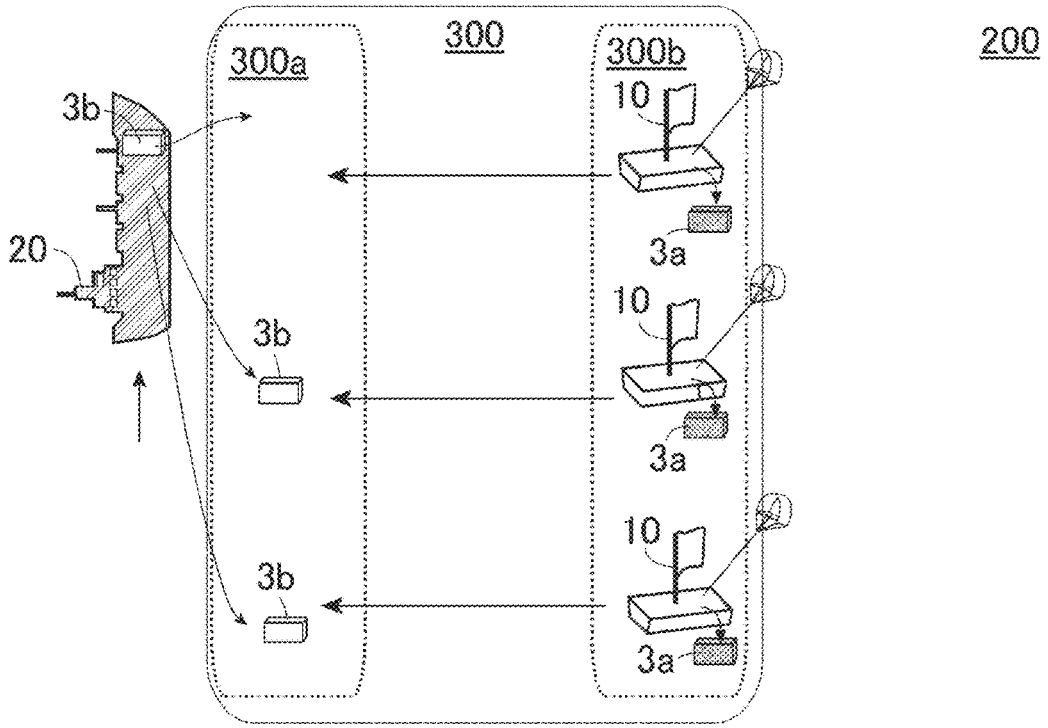
FIG. 3B is a diagram illustrating a process of transferring a storage medium between a power generation floating body and a transport vessel according to the present embodiment, showing a process of dropping a first storage medium from the power generation floating body and dropping a second storage medium from the transport vessel.

First, as depicted in FIG. 3A, each of the power generation media 10 loaded with the energy-stored storage media 3*a* is moved to a first area 300*b* within the sea area 300. On the other hand, the transport vessel 20 loaded with the energy-storable or empty storage medium 3*b* is moved to the second area 300*a* in the sea area 300. Then, as illustrated in FIG. 3B, the storage medium 3*a* is dropped onto the water surface from the power generation medium 10 in the first area 300*b*, and the storage medium 3*b* is dropped onto the water surface from the transport vessel 20 in the second area 300*a*. The method of dropping may be performed in any manner. The storage medium 3*a*, 3*b* is configured to float on the water surface as previously mentioned, so that the dropped storage medium 3*a*, 3*b* will remain on the water surface.

Figure 4A:
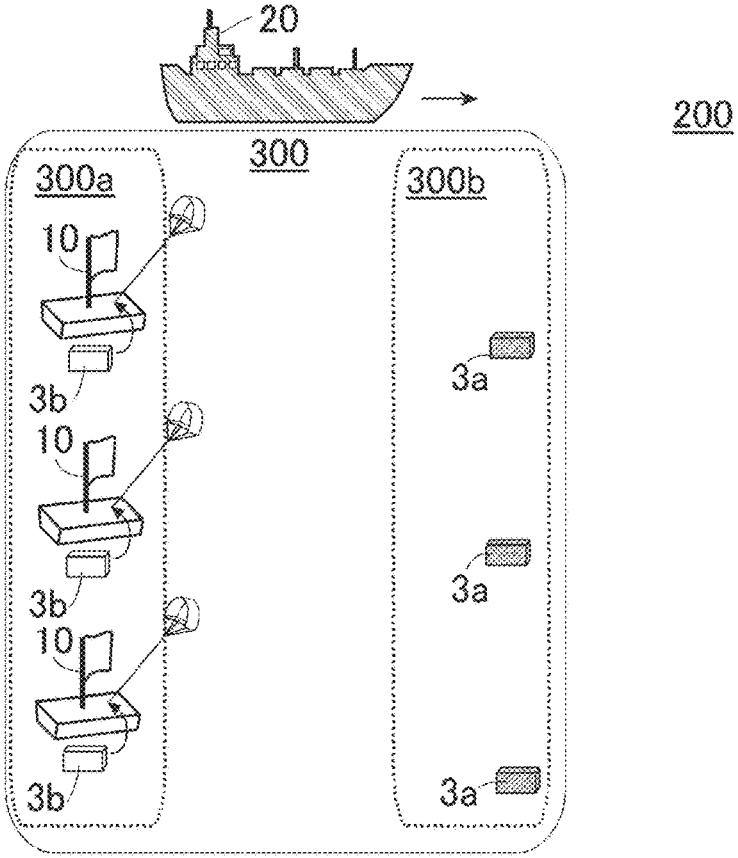
FIG. 4A is a diagram illustrating a process of transferring a storage medium between a power generation floating body and a transport vessel according to the methods of the present embodiment, illustrating a process of recovering a second storage medium to the power generation floating body.
Figure 4B:
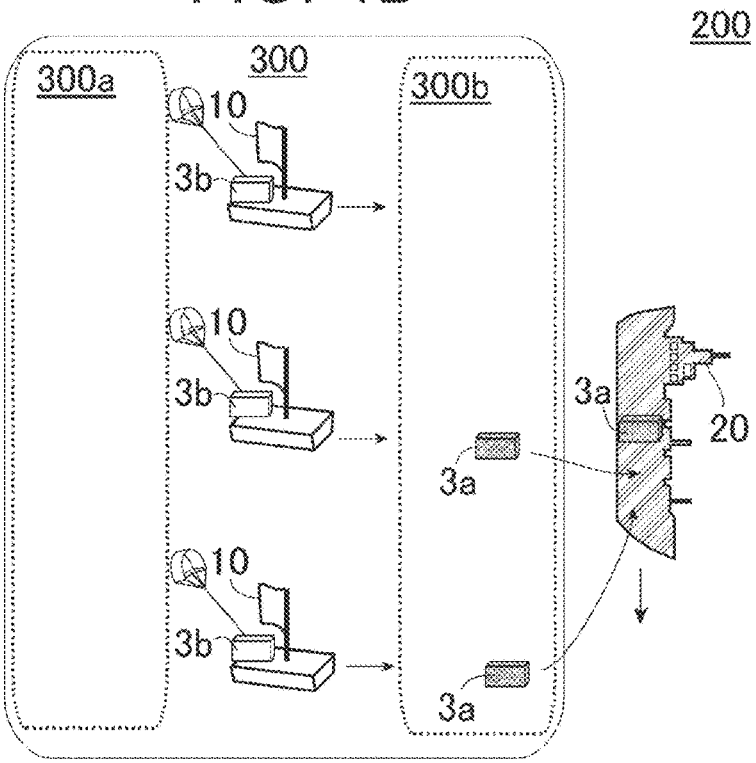
FIG. 4B is a diagram illustrating a process of transferring a storage medium between a power generation floating body and a transport vessel according to the methods of the present embodiment, illustrating a process of recovering a first storage medium to a transport vessel.

Thereafter, as shown in FIG. 4A, the power generation medium 10 proceeds to the second area 300*a*, where the storage medium 3*b* dropped from the transport vessel 20 is unloaded and loaded, and the transport vessel 20 is directed to the first area 300*b*. Then, as shown in FIG. 4B, the power generation medium 10 moves along the predetermined course 11 in the sea area 200, while the transport vessel 20 moves while pulling up the storage medium 3*a* dropped by the power generation medium 10 in the first area 300*b*, and returns to the port 100.

According to the above-described configuration, the storage medium 3*a* dropped by the power generation medium 10 and the storage medium 3*b* dropped by the transport vessel 20 float in separate regions, and thus the recovery of each of them is facilitated. Note that the first area 300*b* and the second area 300*a* may be set in the vicinity of the turning point of the moving course 11 of the power generation medium 10.

Withdrawal and Recovery of Offshore Storage Media

In the above configuration, the storage medium 3*a*, 3*b* dropped on the ocean may be withdrawn by the power generation medium 10 and the transport vessel 20 in any manner. In this regard, it is preferable that the configuration for the power generation medium 10 and the transport vessel 20 to detect the storage medium 3*a*, 3*b* be provided in the power generation medium 10 and the transport vessel 20 and the storage medium 3*a*, 3*b* so that the power generation medium 10 and the transport vessel 20 can efficiently recover the storage medium 3*a*, 3*b* on the ocean. In addition, it is preferable that the recovery of the storage medium 3*a*, 3*b* by the power generation medium 10 and the transport vessel 20 is automatically and unattended.

For this purpose, as already described, in the present embodiment, first, as already described, the storage medium 3 is provided with a light emitter or a transmitter that emits a specific light or radio wave as the marker means 8. Alternatively, a reflector that reflects light and radio waves emitted from the power generation medium 10 and the transport vessel 20 is provided. On the other hand, the power generation medium 10 and the transport vessel 20 are provided with a detection unit that detects light and radio waves coming from the storage medium 3 (reference numeral 9 in FIGS. 5A to 5E). As a result, the position of the storage medium 3 from the power generation medium 10 and the transport vessel 20 can be detected. When the storage medium 3 on the ocean is recovered by the power generation medium 10 and the transport vessel 20, the recovery unit may be operated to recover the storage medium 3*a*, 3*b* based on the detected position of the storage medium 3.

Figure 5A:
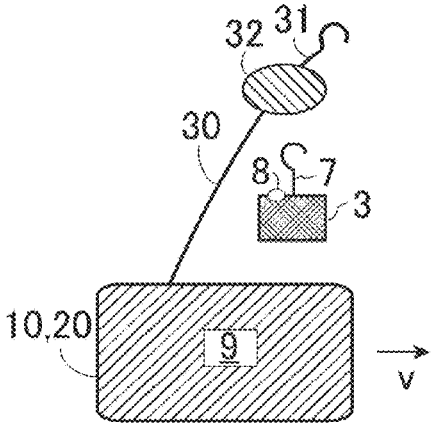
FIG. 5A is a schematic depicting a process of recovering storage media on a power generation floating body structure and a transport vessel in one aspect of the methods of the present embodiment.
Figure 5B:
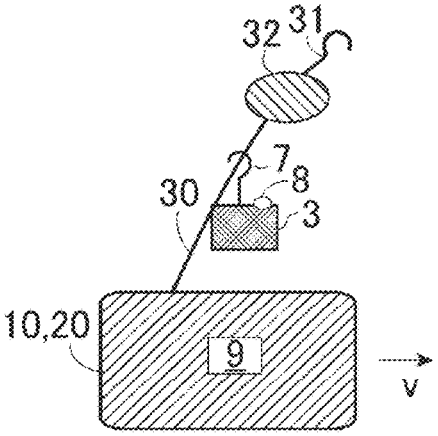
FIG. 5B is a schematic depicting a process of recovering storage media on a power generation floating body structure and a transport vessel in one aspect of the methods of the present embodiment.
Figure 5C:
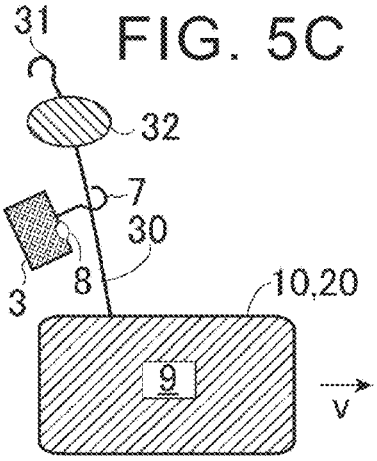
FIG. 5C is a schematic depicting a process of recovering storage media on a power generation floating body structure and a transport vessel in one aspect of the methods of the present embodiment.
Figure 5D:
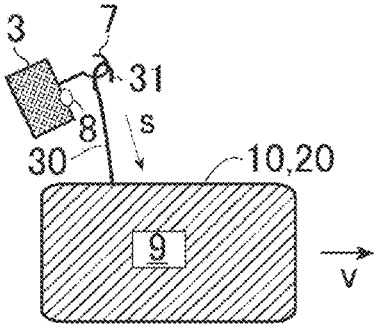
FIG. 5D is a schematic depicting a process of recovering storage media on a power generation floating body structure and a transport vessel in one aspect of the methods of the present embodiment.
Figure 5E:
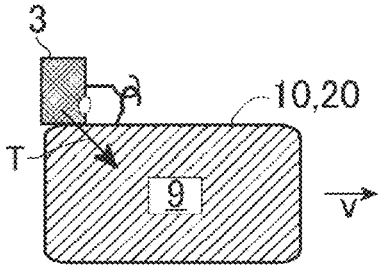
FIG. 5E is a schematic depicting a process of recovering storage media on a power generation floating body structure and a transport vessel in one aspect of the methods of the present embodiment.

In one embodiment of the recovery of the storage medium 3 in the power generating medium 10 and the transport vessel 20, the marker means 8 of the storage medium 3 is detected by the detecting means 9 while the power generating medium 10 or the transport vessel 20 is moved as indicated by an arrow v, as schematically depicted in FIG. 5A to 5E. Then, an arm 30 having a hook 31 and a floating bag 32 for floating the hook from the edge of the power generation medium 10 or the transport vessel 20 is thrown into the vicinity of the storage medium 3 (see FIG. 5A). Then, the hook 7 of the storage medium 3 is hooked on the arm 30 which moves together with the movement of the power generation medium 10 or the transport vessel 20 (FIG. 5B), and thereafter, while the power generation medium 10 or the transport vessel 20 is moved, the arm 30 is shortened (FIG. 5C) (the floating bag 32 is contracted as appropriate), and the hook 7 of the storage medium 3 and the hook 31 of the arm 30 are engaged with each other (FIG. 5D). Thereafter, the storage medium 3 may be pulled up to the edge of the power generation medium 10 and the transport vessel 20 (see FIG. 5E), and may be slid along a movable slope (not shown) or the like on the vessel, as indicated by an arrow T, and pulled up. Such a series of processes can be performed automatically and unattended. The connection between the storage medium 3 and the arm 30 may be achieved by any method, for example, a method using a magnetic force or a negative pressure, regardless of a mechanical method.

Figure 6A:
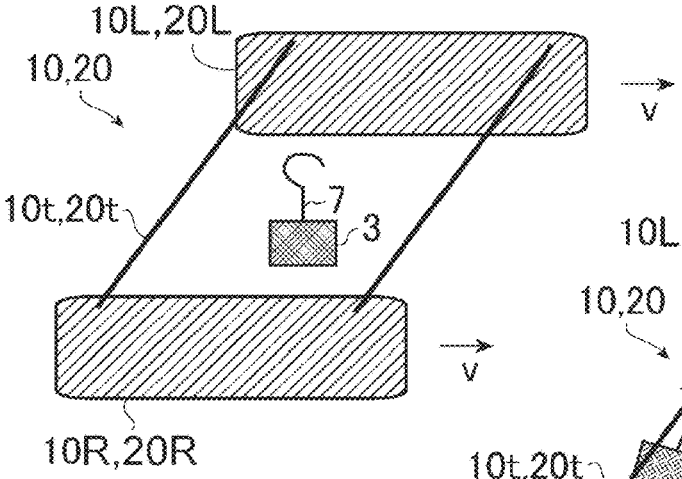
FIG. 6A is a schematic diagram illustrating a process of recovering a storage medium in a power generation floating body and a transport vessel according to another aspect of the methods of the present embodiment.
Figure 6B:
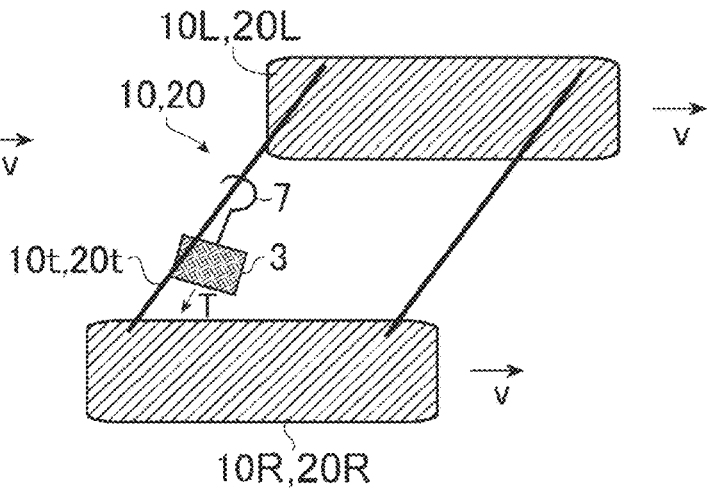
FIG. 6B is a schematic diagram illustrating a process of recovering storage media on a power generation floating body and a transport vessel in another aspect of the process of the present embodiment.

As another aspect of the recovery of the storage medium 3 in the power generation medium 10 or the transport vessel 20, the power generation medium 10 and the transport vessel 20 have a twin-hull construction in which a parallel-aligned fuselage 10R, 20R and a fuselage 10L, 20L are connected, as schematically illustrated in FIG. 6A and FIG. 6B. In this case, the power generation medium 10 and the transport vessel 20 are moved as indicated by an arrow v. Once the storage medium 3 has entered between the fuselage 10R, 20R and the fuselage 10L, 20L, as shown in FIG. 6A, a wire 10*t*, 20*t* is suspended between the fuselage 10R, 20R and the fuselage 10L, 20L. By moving the power generation medium 10 and the transport vessel 20, the hooks 7 of the storage medium 3 are hooked on the wire 10*t*, 20*t*. Thereafter, the storage medium 3 is withdrawn in any manner towards the fuselage and recovered.

Thus, according to the present embodiment described above, the transfer of the storage medium between the power generation floating body and the transport vessel is achieved without directly connecting the power generation floating body and the transport vessel. Transfer of storage media on the ocean between the power generation floating body 10 and the transport vessel of any size and shape is achievable.

While the above description has been made in connection with embodiments of the present disclosure, many modifications and changes will readily occur to those skilled in the art. The disclosure is not limited to the embodiments illustrated above, but may be applied to various devices without departing from the inventive concept.

What is claimed is:

1. A method of transferring a storage medium at sea, between a power generation floating body that generates electric power at sea and stores energy that is obtained by the power generation in the storage medium, and a transport vessel that transports the storage medium, the method comprising:

a first process of relocating the power generation floating body to a predetermined sea area and dropping a first storage medium that is loaded on the power generation floating body into the sea;

a second process of relocating the transport vessel to the predetermined sea area and dropping a second storage medium that is loaded on the transport vessel into the sea;

a third process of causing the power generation floating body to recover the second storage medium that was dropped from the transport vessel into the sea; and a fourth process of causing the transport vessel to recover the first storage medium that was dropped from the power generation floating body into the sea.

2. The method according to claim 1, wherein in the first process, the power generation floating body is relocated to a first region in the predetermined sea area at which the first storage medium is dropped, in the second process, the transport vessel is relocated to a second region in the predetermined sea area at which the second storage medium is dropped, in the third process, the power generation floating body is relocated to the second region and recovers the second storage medium onto the power generation floating body, and in the fourth process, the transport vessel is relocated to the first region and recovers the first storage medium onto the transport vessel.

3. The method according to claim 1, wherein the first and the second storage media are configured to float on the sea.

4. The method according to claim 3, wherein a hook is provided to each of the first and the second storage media, and the power generation floating body and the transport vessel each extend an arm, including an engaging arrangement for engaging the hook, over the sea to engage the hook with the engaging arrangement, and then retract the arm to recover the first and the second storage media.

5. The method according to claim 1, wherein the power generation floating body and the transport vessel each include a detector for detecting the second and the first storage media at sea, and automatically recover the second and the first storage media.

* * * * *